US006120270A

United States Patent [19]

Parsch

[11] Patent Number: 6,120,270

[45] Date of Patent: Sep. 19, 2000

[54] VANE CELL PUMP

[75] Inventor: Willi Parsch, Bickenbach, Germany

[73] Assignee: Luk Fahrzeug-Hydraulik GmbH & Co. KG, Germany

[21] Appl. No.: 09/061,594

[22] Filed: Apr. 16, 1998

[30] Foreign Application Priority Data

Apr. 16, 1997 [DE] Germany ..... 197 15 741

[51] Int. Cl.[7] ..... F01C 19/08; F03C 2/00

[52] U.S. Cl. ..... 418/133; 418/174

[58] Field of Search ..... 418/133, 174

[56] References Cited

U.S. PATENT DOCUMENTS

| | | | |
|---|---|---|---|
| 4,198,195 | 4/1980 | Sakamaki et al. | 418/133 |
| 4,696,866 | 9/1987 | Tanaka et al. . | |
| 5,024,591 | 6/1991 | Nakajima | 418/179 X |
| 5,044,908 | 9/1991 | Kawade | 418/179 |
| 5,338,168 | 8/1994 | Kondoh et al. | 418/179 |
| 5,356,277 | 10/1994 | Yamaguchi et al. | 418/179 |
| 5,478,220 | 12/1995 | Kamitsuma et al. . | |

FOREIGN PATENT DOCUMENTS

| | | |
|---|---|---|
| 0796926 | 9/1997 | European Pat. Off. . |
| 2913419 | 9/1980 | Germany . |
| 2915235 | 10/1980 | Germany . |

OTHER PUBLICATIONS

Partial English translation of W. Lehnert, et al., Aluminium–Taschenbuch, pp. 270–277 and 398–401. 1996.
Partial English translation of DE 2913419. Sep. 1980.
Partial English translation of DE 2915235. Oct. 1980.
W. Lehnert, et al., Aluminium–Taschenbuch, pp. 270–277 and 398–401. 1996.

*Primary Examiner*—Hoang Nguyen
*Attorney, Agent, or Firm*—Ostrolenk, Faber, Gerb & Soffen, LLP

[57] ABSTRACT

A vane cell pump comprises a lifting ring forming at least one suction and one pressure chamber, a rotor movably arranged in the lifting ring and having radially movable vanes, and at least one pressure plate forming a lateral surface of the suction and pressure chamber, characterized in that the pressure plate (23, 25) is made of a near or hypo-eutectic aluminium alloy which contains silicon and which undergoes heat treatment.

10 Claims, 1 Drawing Sheet

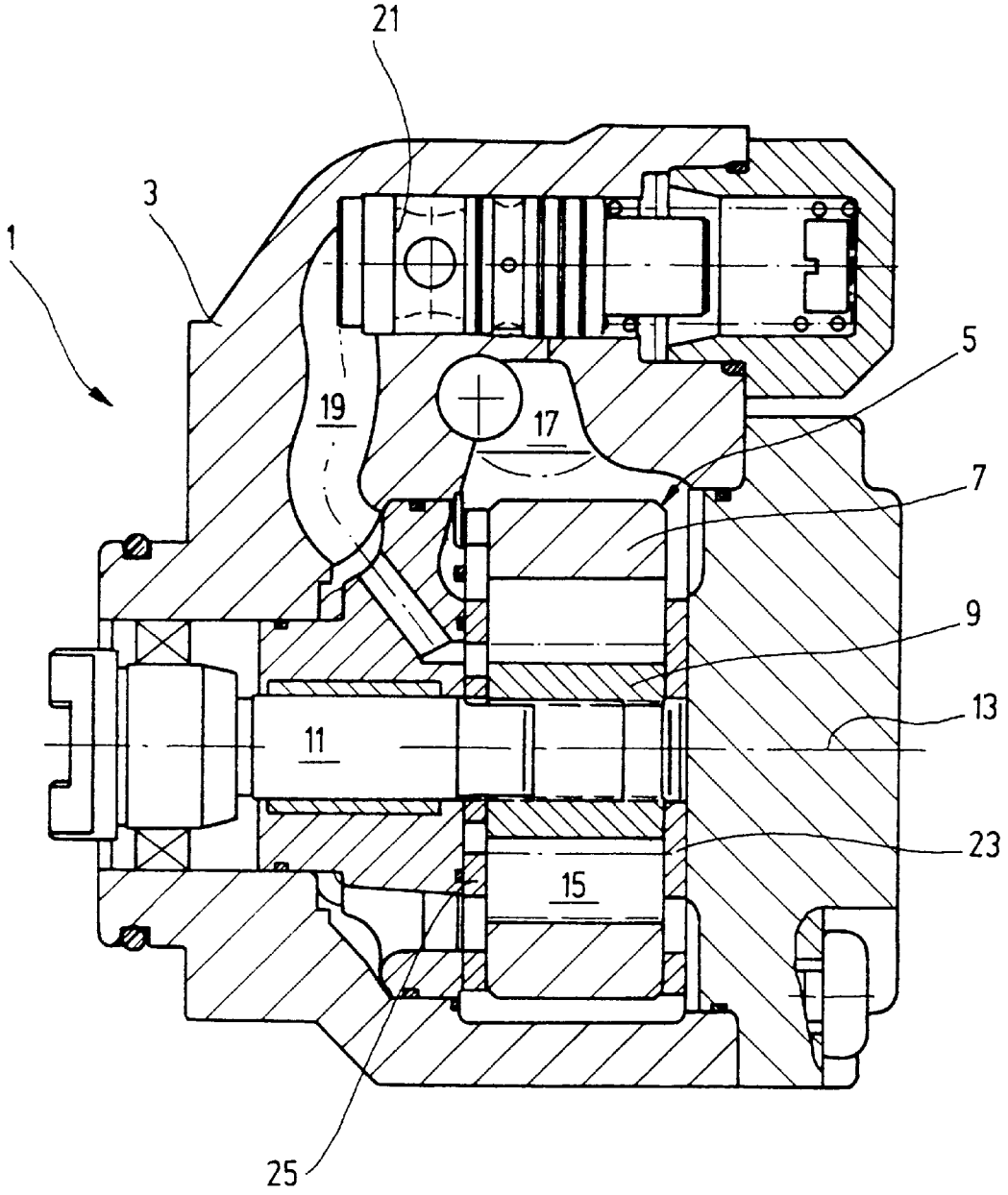
21
3
1
5
19
17
7
9
13
11
23
15
25

VANE CELL PUMP

The invention relates to a vane cell pump according to the pre-characterising part of claim 1 and a process of manufacturing a vane cell pump according to the pre-characterising part of claim 4.

Vane cell pumps and processes of manufacturing them are well known. They are characterised by a rotor having radial slots and arranged so that it can rotate within a lifting ring. Vanes are movably arranged in the slots. When the rotor rotates with the vanes inside the lifting ring, this creates chambers which increase and decrease in size providing at least one suction and one pressure chamber respectively connected to the suction inlet and the pressure outlet of the pump. On the side of the lifting ring and on the rotor there is at least one pressure plate to seal the suction and pressure chambers. An adjacent surface of the pump housing is arranged on the other side of the lifting ring. However, it is also possible to fit another pressure plate here. It has turned out that such vane cell pumps are very prone to wear. Cavitation erosion causes tiny particles to be torn from the surfaces of the pressure plate(s) facing the rotor and the lifting ring, and these then get into the oil and wear the pump and further wear the consumer supplied by the pump.

To ensure minimum wear, the pressure plates of conventional vane cell pumps are manufactured from sinter-metal or an hyper-eutectic aluminium silicon alloy (Al—Si alloy). This has the advantage over the sinter metal that it is lighter, and manufacturing the pressure plate from this material is cheaper. A pressure plate made from hyper-eutectic aluminium silicon alloy is characterised by its strength, and the primary silicon crystals hinder wear. If the Al—Si alloy is refined by adding sodium or strontium, very fine silicon crystals are formed, which improve the mechanical characteristics, particularly the tensile strength. It is also known that the wearing properties of the Al—Si alloy can be improved by means of an hyper-eutectic structure and a high proportion of silicon. It has been shown that, if the pressure plate is made from an hyper-eutectic Al—Si alloy and demonstrates good strength, cavitation erosion, which can also be described as vibration friction wear, still occurs, wearing both the pump and the consumer supplied by the pump.

Therefore an object of the invention is to provide a vane cell pump and a process of manufacturing such a pump in which the above-mentioned disadvantages are avoided.

The invention provides a vane cell pump as claimed in claim 1. The pump is characterised by the fact that the pressure plate(s) is made of a near or hypo-eutectic aluminium alloy, which contains silicon. Therefore the wear on the pressure plate is relatively low, because heat treatment prevents an uneven structure in the aluminium alloy. In particular, it is possible to avoid tiny grains in the hard parts of the structure which could break off. The heat treatment causes the silicon to coarsen and become globular, i.e. it becomes more rounded. The heat treated near or hypo-eutectic aluminium alloy, which contains silicon, demonstrates—contrary to expert opinion—better cavitation properties than hyper-eutectic aluminium alloys with a high silicon content. After the glow treatment, this near or hypo-eutectic Al—Si alloy is coarse and hypo-eutectic in character, and the coarse, round crystals do not break off on cavitation or vibration friction.

In a preferred embodiment of the vane cell pump the pressure plates contain secondary structure parts made of silicon, which are largely rounded silicon grains of a defined minimum size. These round structures tend only to a low degree to break off, so that the surface of the pressure plate shows very few defects, even when the pump is running. In addition tiny particles which can cause abrasion are avoided. The hard, rounded silicon grains remain more in the structure of the alloy and make the surface of the pressure plate highly resistant to breaking off.

In a particularly preferred embodiment of the vane cell pump the proportion of silicon in the pressure plate(s) is approximately 9%.

In order to achieve the object of the invention a process for manufacturing vane cell pumps is provided as claimed in claim 4. The pressure plate is manufactured from a near or hypo-eutectic aluminium alloy which has a proportion of silicon. It is subjected to heat treatment, which reduces the wear on the pressure plate, as it prevents the formation of tiny, needle-like, long, narrow silicon grains which can break off from the surface of the pressure plate while the pump is running.

The invention will now be described in more detail by means of the accompanying drawing, which shows a longitudinal section of a vane cell pump in accordance with the invention.

Vane cell pumps of the type described are well-known, so that only a short description is required here. The vane cell pump 1 shown as a section in the drawing has a housing 3 in which a pump unit 5 is housed. The pump comprises a lifting ring 7 within which a rotor 9 rotates driven by means of a drive shaft 11. The rotor 9 has slots extending radially to the axis of rotation 13, and radially movable vanes 15 are located in these slots. When the rotor 9 rotates inside the lifting ring 7, this creates chambers which increase and decrease in size, there being at least one suction and one pressure chamber. Preferably, there are two suction chambers and two pressure chambers. When the rotor 9 turns, a medium, for example oil, is drawn from a suction inlet 17 having a suction connection and fed to a pressure outlet 19 having a pressure connection. The pressure outlet 19 is connected to a consumer by means of a flow regulator valve 21.

In the embodiment of the vane cell pump 1 shown here there are two pressure plates 23 and 25 which sealingly engage the lifting ring 7, the rotor 9 and the vanes 15. The pressure plates 23 and 25 are pressed against the pump unit 5 when the pump is operating, and are subject to wear, particularly in the area in contact with the rotating parts of the pump unit 5.

The pressure plates, which can be substantially thicker than in the embodiment shown in the drawing, are made of an aluminium alloy which also contains a proportion of silicon. The alloy is near or hypo-eutectic and undergoes heat treatment. This serves to convert the needle-like, long, narrow silicon grains found in the alloy. Preferably, the heat treatment should be carried out in such a way that the secondary structure parts made of silicon largely have rounded grains. The needles can, for example, be about 1 $\mu$m to 10 $\mu$m in lengths and 0.1 $\mu$m in thickness. Therefore these break off very easily from the basic structure. The rounded grains are not pointed and therefore hardly break off when the pump is in operation, so that, these hard parts remain in the plates and do not cause wear. They are approximately 2 $\mu$m to 5 $\mu$m in size.

Before the heat treatment, the near or hypo-eutectic alloy contains needle crystals, which would break off due to cavitation or vibration friction wear. The heat treatment, particularly glow treatment, makes the needle crystals merge into coarse, round crystals. In this regard it should be indicated that the silicon crystals cannot be coarsened by refining the near or hypo-eutectic aluminum silicon alloy by means of adding supplements such as sodium or strontium. The heat treatment of the near or hypo-eutectic aluminium alloy also reduces the strength.

Contrary to expert opinion, which favours a high proportion of silicon, a hyper-eutectic, fine structure and also a refining of the aluminium alloy in order to prevent wear, and which advises against heat treatment because it reduces tensile strength, the pressure plates made from a near or hypo-eutectic aluminium alloy demonstrate better cavitation properties than the standard pressure plates described above, which are made from a hyper-eutectic aluminium alloy with a high silicon content.

An aluminium alloy with a silicon content of 7.5% to 14.5%, preferably from 8.5% to 13.5%, is preferred as the basic material to be heat treated. An aluminium alloy with a silicon content of 9% has proven particularly successful.

It is clear from the description of the drawing that vane cell pumps 1 can be made with only one pressure plate. On the side opposite the pressure plate, the pump unit 5 can rest against a surface formed directly by the housing 3 of the vane cell pump 1. However, embodiments of the vane cell pump 1, which, as shown here, have two pressure plates 23 and 25 are preferred.

When manufacturing a vane cell pump 1 of the type described here, pressure plates are used which are made from a near or hypo-eutectic aluminium alloy. The silicon content of the aluminium alloy is from 7.5% to 14.5%, preferably from 8.5% to 13.5%, is preferred as the basic material to be heat treated. A process where the aluminium alloy has a silicon content of approximately 9% is particularly preferred. After it is produced, or in a pressure moulding process, the pressure plate undergoes heat treatment, which forms secondary structure parts within the pressure plate primarily having rounded grains, which are about 2 $\mu$m to 5 $\mu$m in size.

Overall it can be seen that the above-described vane cell pump has very low wear levels. This is due to the fact that needle-like, long, narrow silicon grains in the surface of the pressure plates 23 and 25, which engage the pump unit 5, are converted into rounded grains. When the vane cell pump is running, these silicon grains form a supporting surface. Their rounded form means that these silicon grains cannot be torn out of the surface or broken off, so that there are very few abrasive substances in the pump medium or the hydraulic oil. Rather, the hard silicon grains remain as a protection against wear in the surface of the pressure plates. This minimises wear through abrasion and/or cavitation.

What is claimed is:

1. A vane cell pump comprising a lifting ring forming at least one suction and one pressure chamber, a rotor movably arranged in the lifting ring and having radially movable vanes, and at least one pressure plate forming a lateral surface of the suction and pressure chamber, characterised in that the pressure plate (23, 25) is made of a near or hypo-eutectic aluminium alloy which contains silicon and undergoes heat treatment.

2. A vane cell according to claim 1, characterised in that the pressure plate (23, 25) contains secondary structure parts made of silicon, the grains of which are largely rounded.

3. A vane cell pump according to claim 1, characterised in that the silicon content is between 7.5% and 14.5%.

4. A method of manufacturing a vane cell pump with a lifting ring forming at least one suction and one pressure chamber, a rotor movably arranged in the lifting ring and having radially movable vanes, and at least one pressure plate forming a lateral surface of the suction and pressure chamber, characterised that the pressure plate (23, 25) is made of a near of hypo-eutectic aluminum alloy containing silicon and that the pressure plate undergoes heat treatment.

5. A vane cell pump according to claim 2, characterized in that the silicon content is between 7.5% and 14.5%.

6. A vane cell pump according to claim 1, wherein the silicon content is between 8.5% and 13.5%.

7. A vane cell pump according to claim 1, wherein the silicon content is approximately 9%.

8. A vane cell pump according to claim 2, wherein the silicon content is between 8.5% and 13.5%.

9. A vane cell pump according to claim 2, wherein the silicon content is approximately 9%.

10. A vane cell pump according to claim 2, wherein the grains of silicone are approximately 2 um to 5 um in size.

* * * * *